United States Patent [19]

Manning

[11] Patent Number: 4,729,302

[45] Date of Patent: Mar. 8, 1988

[54] FLOATING CONTAINER CLAMP FOR A COMPACTION PRESS

[76] Inventor: Douglas E. Manning, 7300 Rule Rd., Knoxville, Tenn. 37920

[21] Appl. No.: 864,295

[22] Filed: May 16, 1986

[51] Int. Cl.[4] ..... B30B 15/04

[52] U.S. Cl. ..... 100/214; 100/246; 100/269 R

[58] Field of Search ..... 100/91, 229.A, 295, 100/214, 232, 233, 245, 246, 253, 251, 252

[56] References Cited

U.S. PATENT DOCUMENTS

| | | | |
|---|---|---|---|
| 2,500,819 | 3/1950 | Hall et al. | 100/214 X |
| 3,631,795 | 1/1972 | Maxwell | 100/245 X |
| 4,273,037 | 6/1981 | Ruebesam | 100/91 |
| 4,284,000 | 8/1981 | Almeda, Jr. | 100/295 X |
| 4,413,555 | 11/1983 | Swinney | 100/214 |
| 4,550,657 | 11/1985 | Van Doorn et al. | 100/246 X |

FOREIGN PATENT DOCUMENTS

| | | | |
|---|---|---|---|
| 2413398 | 10/1975 | Fed. Rep. of Germany | 100/214 |

*Primary Examiner*—Andrew M. Falik

[57] ABSTRACT

A box type container used in a press for compacting materials is supported by a floating clamp arrangement that protects the container during compaction and allows significantly higher compaction pressures to be used. The clamps are supported with spherical connections and are pressed to the container with hydraulic cylinders. A container that is fabricated out of square with generous dimensional tolerances is protected as the clamps float to conform to the container being used. All sides and bottom of the box type container are protected with this arrangement.

3 Claims, 8 Drawing Figures

FLOATING CONTAINER CLAMP FOR A COMPACTION PRESS

BACKGROUND OF THE INVENTION

1. Field of the Invention

The present invention relates to a clamping technique that is useful for protecting box type containers while compacting material in them.

2. Description of the Prior Art

When compacting material into a box type container using a compaction press, the material being compacted will exert pressure on the container sides and bottom causing these surfaces, particularly the sides, to detrimentally bow outward if beyond their design pressure or if they are not externally supported in some way. In addition, when compacting sharp rigid objects as are sometimes encountered with waste material, these surfaces are subject to being breached, thus causing damage that could render the container unusable.

A clamping device offering a solution to this problem is noted as a part of the compacting machine in U.S. Pat. No. 4,273,037 which uses a fork arrangement to hold the long sides of a box container.

The present invention offers improvements over this type of support and allows significantly higher compaction pressures while protecting against breaching of the container surfaces.

SUMMARY OF THE INVENTION

According to the present invention, the problem is reduced by supporting all surfaces of a box type container using clamps fabricated with flat steel plates which are structurally stiffened to lessen bowing, and are supported with commercially available spherical rod ends. The clamps are pressed to the container sides with hydraulic cylinders connected to a common pressurized hydraulic fluid supply. The spherical connections allow the clamps to conform to a container that is fabricated out of square or of varying dimensions. Supporting the container on all sides allows high clamping forces on a relatively thin gage container enabling the flat clamp surfaces to flatten the container surfaces. Connecting the supporting hydraulic cylinders to a common supply line will equalize the pressure over each container surface. Each surface is immediately backed up by much heavier steel plates effectively preventing most types of breaching or piercing of the thin container surface.

The compactor access door may also be fabricated with a flat steel plate structurally stiffened as the clamps. This enables the arrangement to use three hydraulically operated clamps with the door serving as both a reference datum on the compactor and a support for one container side. One corner of the two end clamps is also fixed on a spherical joint and serves as a reference datum for the axis perpendicular to the door. This enables the compactor to operate by retracting the clamps, opening the door, placing a container in the machine, and closing the door. When the clamps are extended the container will thus be supported and correctly located by the reference datums to allow the compactor platen to enter the container symmetrically with the fabrication tolerances. The bottom surface of the container is supported by the base plate on the compactor.

The invention as described effectively solves the problems of protecting a box type container during compacting, allowing significantly higher compaction pressures to be used.

BRIEF DESCRIPTION OF THE DRAWINGS

In the drawings:

FIG. 4 is not taken from any other Figs.

DETAILED DESCRIPTION

Figure 1:
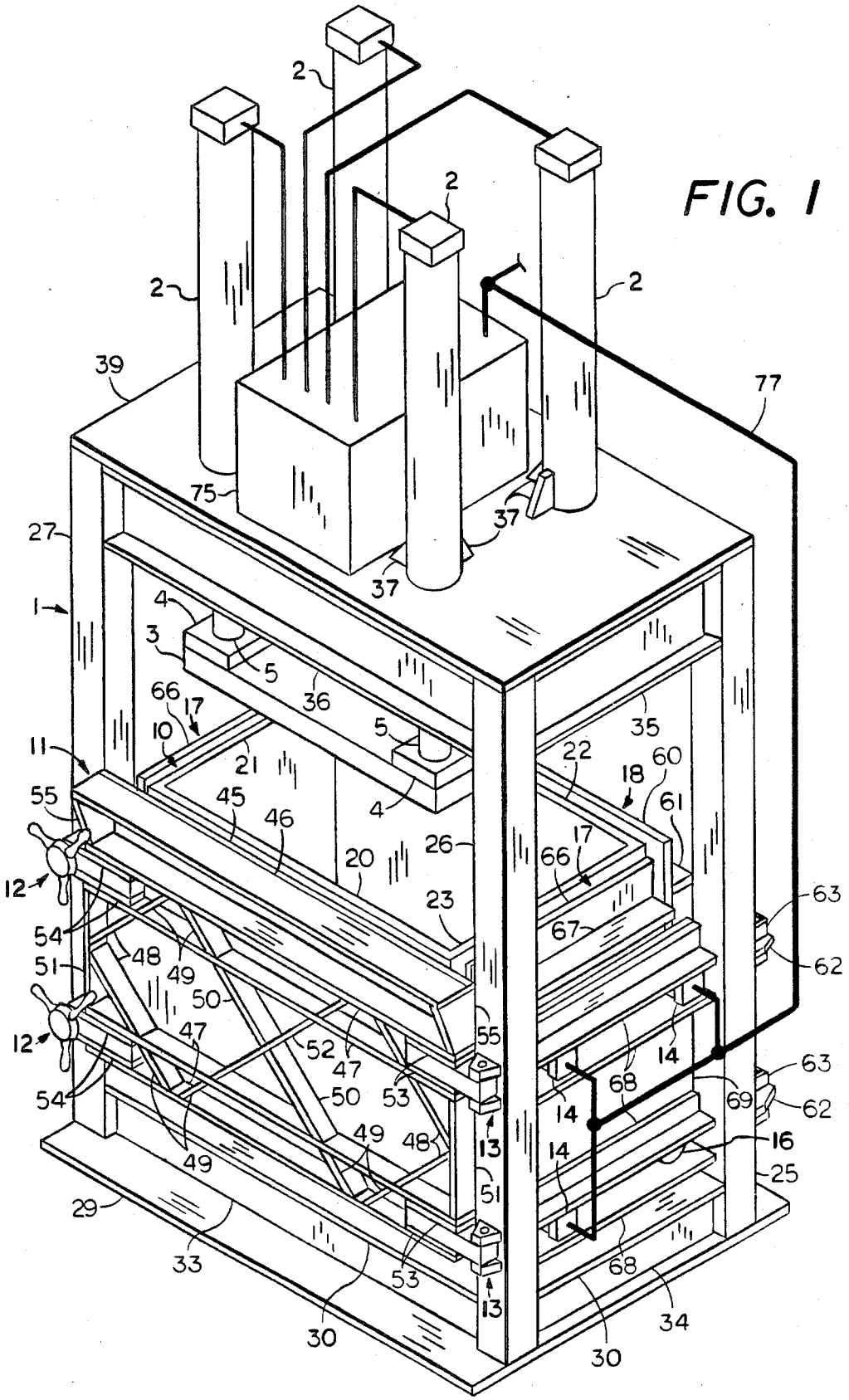
FIG. 1 is a front perspective view of a box container compaction press and illustrates the access door, platen, press frame, platen cylinders, three side clamp cylinders, supporting structure, pressurized hydraulic fluid supply, and a container.
Figure 2:
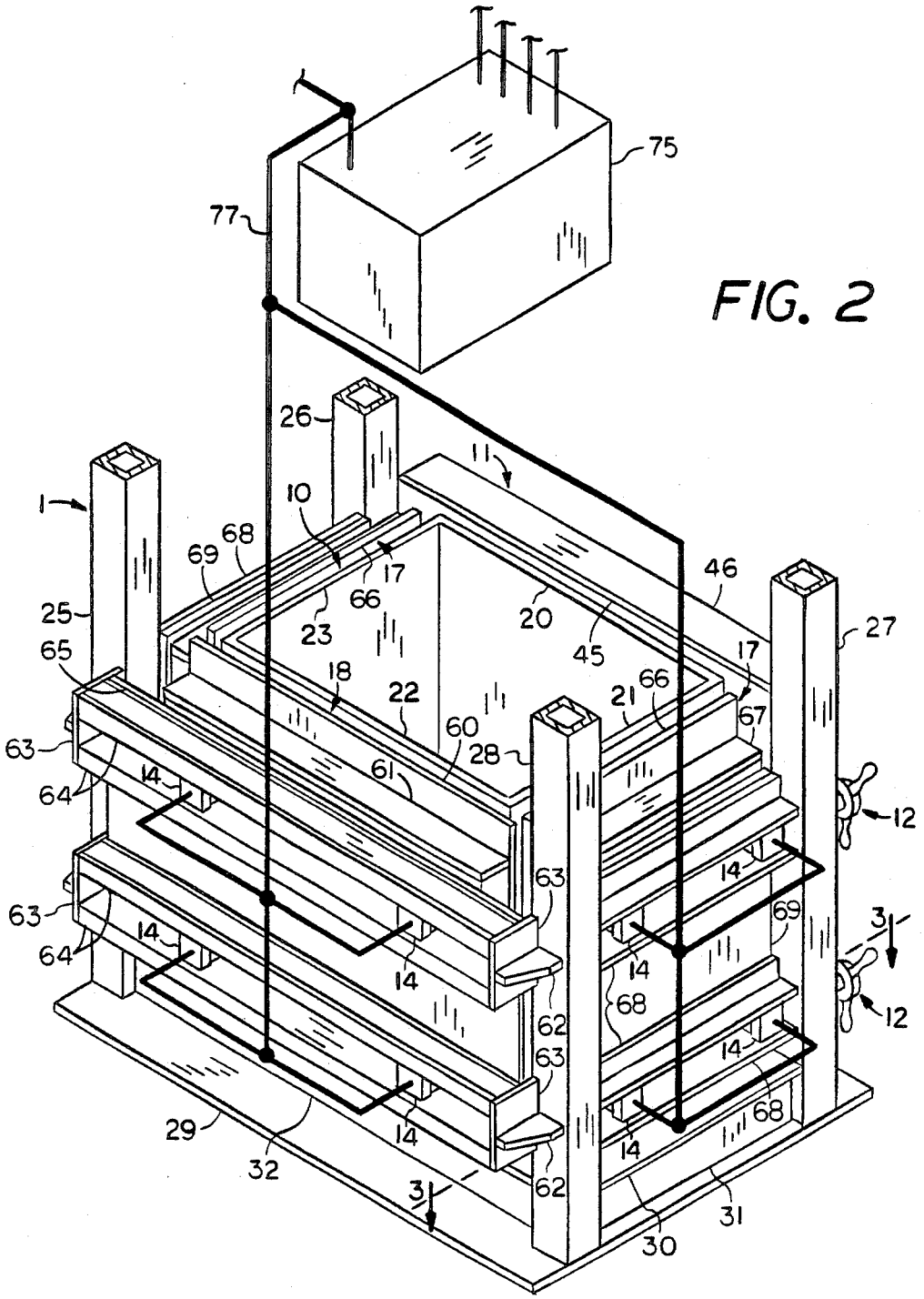
FIG. 2 is a rear perspective view of the bottom portion of the same press as FIG. 1 and further illustrates the rear and side clamp cylinders, supporting structure, and pressurized hydraulic fluid supply with common lines.
Figure 3:
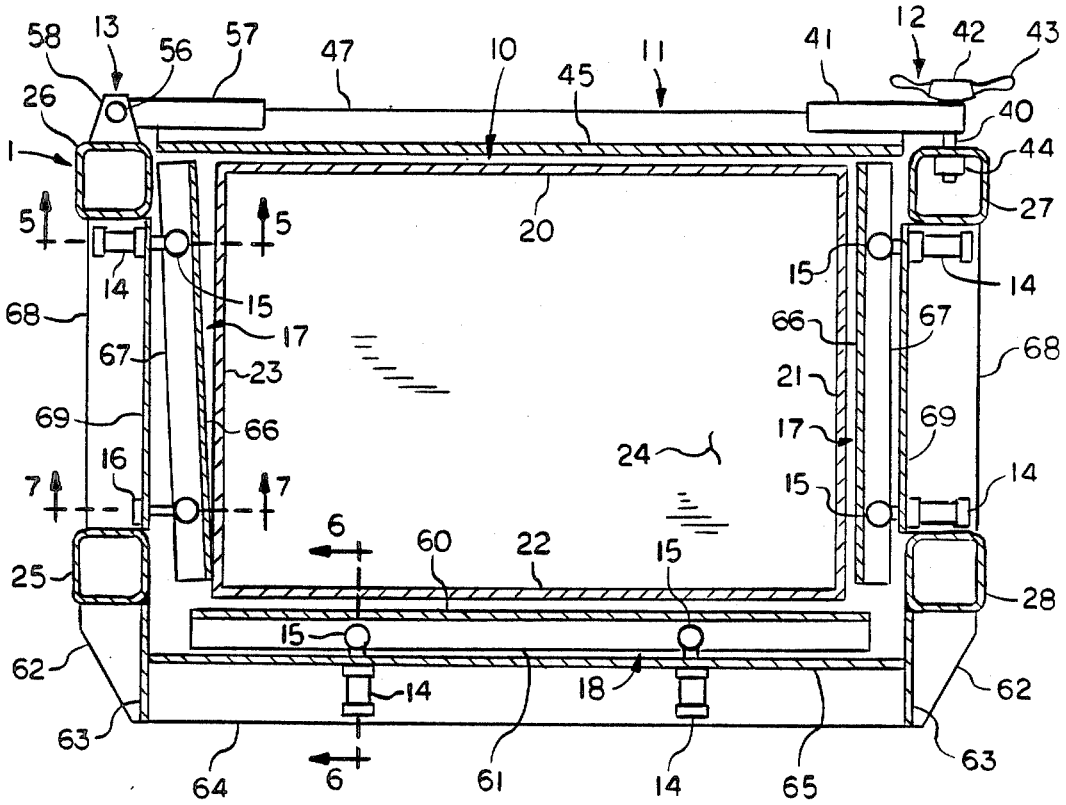
FIG. 3 is a top sectional view taken from FIG. 2 and illustrates the side and rear clamps and supporting structure, access door, a fastener, a hinge, the compactor uprights, and an outline of a container. The clamps appear retracted in this view.
Figure 4:
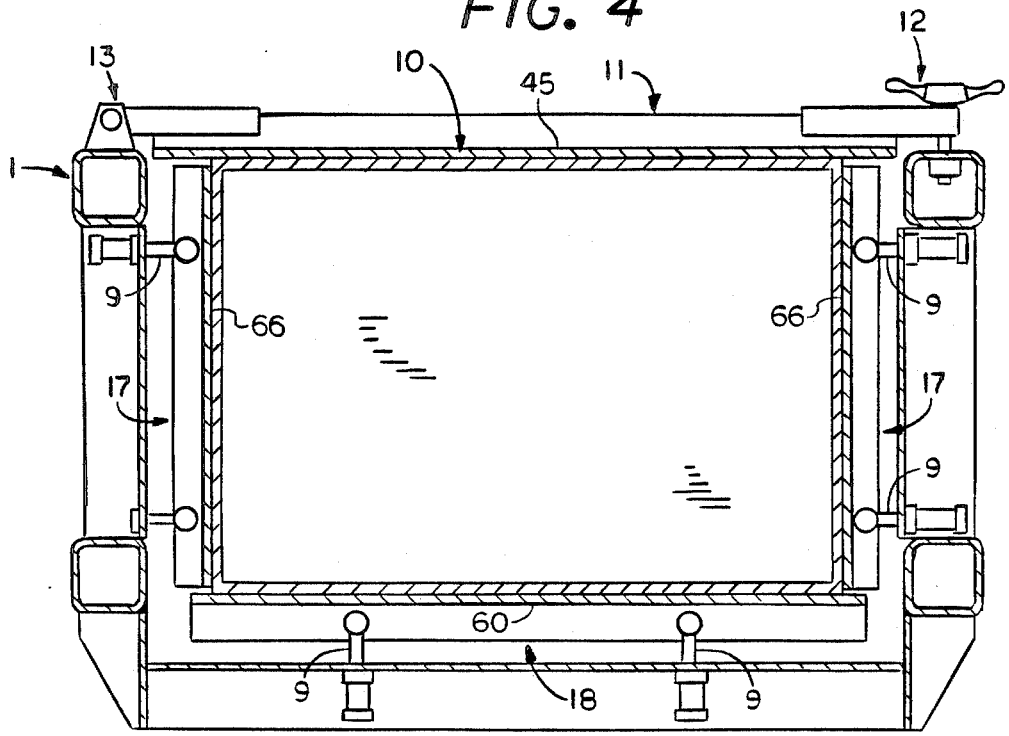
FIG. 4 is a sectional view identical to FIG. 3 except the clamps are illustrated pressing against the container sides.
Figure 5:
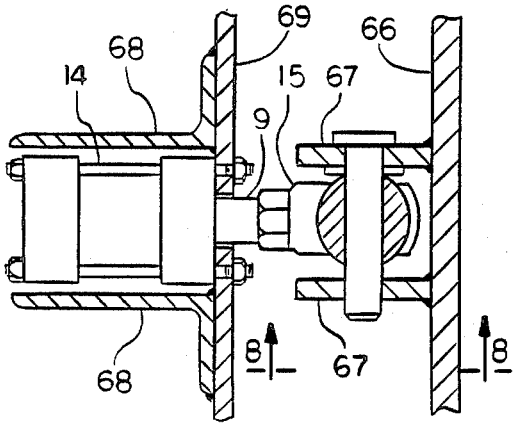
FIG. 5 is a sectional view taken from FIG. 3 and illustrates a side clamp cylinder and frame mount, and a commercially available spherical rod end connected to the side clamp. The illustrated cylinder is an industrial standard type mount.
Figure 6:
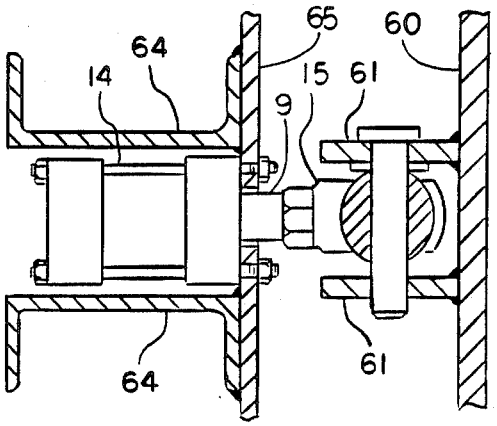
FIG. 6 is a sectional view taken from FIG. 3 similar to FIG. 5 and illustrates a rear clamp cylinder and frame mount, and a commercially available spherical rod end connected to the rear clamp. The illustrated cylinder is an industrial standard type mount.
Figure 7:
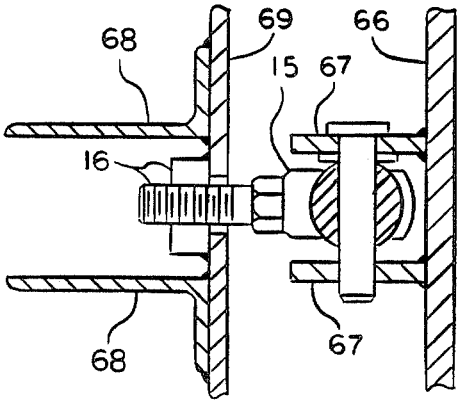
FIG. 7 is a sectional view taken from FIG. 3 similar to FIG. 5 with an adjustable container locating mount connected directly to the frame in lieu of the clamp hydraulic cylinder, a commercially available spherical rod end connected to the side clamp is also illustrated.

Referring to FIGS. 1–4, a press frame 1 is illustrated as comprising members 25,26,27,28,29,30,31,32,33,34,35,36,37, and 39. Member 30, noted in FIG. 1 and FIG. 2, is the base plate that also supports the container bottom 24, noted in FIG. 3. The container 10 is illustrated as having an open top, four sides 20,21,22, and 23, and a bottom 24. The door 11 is illustrated in FIG. 1 as comprising members 45,46,47,48,49,50,51,52,53,54, and 55. The two fasteners 12 are illustrated in FIG. 3 as comprising members 40,41,42,43, and 44. The two hinges 13 that allow the door to pivot relative to the frame 1 are illustrated in FIG. 3 as comprising members 56, 57 and 58. The hydraulic clamp cylinders 14 are illustrated by FIGS. 1–6 as a standard commercially available type with cylinder rods 9. The spherical rod ends 15 are also illustrated by FIGS. 5–7 as a standard commercially available type and allow pivotal movement in directions perpendicular to the clamp inner surface. The side clamp frame support structure is illustrated by FIGS. 1–3 as comprising plates 69 and structural angles 68. The side clamps 17 are illustrated by FIGS. 1–3 as comprising plates 66 and stiffening bars 67. The rear clamp supporting structure is illustrated by FIGS. 1–3 as comprising plate 65, structural channels 64, and brackets 63,62. The rear clamp 18 is illustrated by FIGS. 1–3 as comprising a plate 60 with stiffening bars 61. The clamps 17,18 are operated by means of a standard commercially available pressurized hydraulic fluid supply 75, through common lines 77 as shown by FIGS. 1–2. A common hydraulic fluid return line is omitted from the illustrations for clarity. The compacting means is illustrated by FIG. 1 as comprising press cylinders 2, platen 3, platen mount 4, press cylinder rods 5, and the pressurized hydraulic fluid supply 75.

With reference to FIGS. 1–2 the present invention is implemented on a compaction press that compacts material into a box type container 10 by means of a platen 3 which enters the container 10 by extension of the press cylinders 2. The press is operated by raising the platen 3, opening the door 11 which swings on the hinges 13, retracting the clamps 17,18 by means of the hydraulic clamp cylinders 14, placing the container 10 in the machine as shown by FIG. 3, closing the door 11 and securely fastening it to the frame 1 by means of the fastener 12.

The clamps 17,18 are then extended with the common pressurized hydraulic fluid to the eleven cylinders 14 shown in FIGS. 1 and 2. The rear clamp 18 and one side clamp 17 in FIG. 2 are supported with four cylinders 14 each. The other side clamp 17 in FIG. 1 is supported with three cylinders 14 with the lower rear corner supported by a mount 16. All cylinders 14 and the one fixed mount 16 are connected to the clamps 17,18 with commercially available spherical rod ends 15 as illustrated by FIGS. 5–7. The mount 16 functions as a datum and may be adjusted for a given container 10 length to allow the container 10 to be centrally located under the platen 3. The door 11 serves as a fixed datum in relationship to the adjustable datum 16 in the axis perpendicular to the door 11, and also may support one side of the container 10 as illustrated by FIG. 4.

Figure 8:
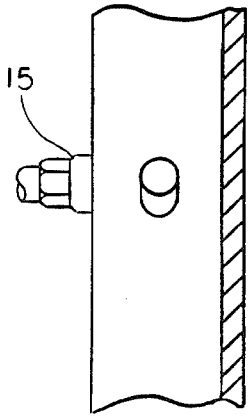
FIG. 8 is a bottom view taken from FIG. 5 and illustrates a clearance hole that allows the clamps to extend on one side only without binding the spherical rod end. This view is typical for all clamp to cylinder connections.

The cylinders 14 are rigidly mounted to the compactor frame and an allowance for extending the cylinder 14 on one side of the clamp 17,18 while the cylinder 14 on the other side of the same clamp 17,18 remains retracted is provided by clearance of the spherical rod ends 15 as illustrated by FIG. 8. Otherwise a clamp 17,18 could bind by extending one side only. The effect is that extending the cylinders 14 will allow the clamps 17,18 to float or conform to a container 10 with nonparallel sides of varying dimensions. The container 10 is then securely supported on all sides except for a small clearance amount on the side clamps 17 as illustrated by FIG. 4. The container bottom is supported by the compactor base plate 30.

The clamps 17,18 and the access door 11 are each fabricated with a flat steel plate which contains the container surface, and are structurally stiffened for sufficient rigidity to prevent twisting or bowing of the flat plate. The plate is much stronger than the container 10 sides and thus provides protection against breaching or piercing of the container 10. In FIG. 4, the plate surfaces that press against the container are 66 for the side clamps 17,45 for the access door 11, and 60 for the rear clamp 18.

From the foregoing description of the operation of the floating container clamp, it should be apparent that a container support is provided which provides a technique for effectively securing and protecting a box type container from pressures encountered during compacting.

Having illustrated and described what is presently the preferred embodiments of the invention, it should be apparent to those skilled in the art that the preferred embodiments may be modified in arrangement and detail without departing from the principles of the invention which are intended to be illustrated but not limited by the disclosure. We therefore claim as our invention all such modifications as come within the true spirit and scope of the following claims:

We claim:

1. A press for compacting material in a container, said container having a bottom, a plurality of sides, and an open top, said press comprising:

a pressurized fluid means;

a vertically movable material compacting means;

a frame, said frame further allowing the bottom of said container to be supported by the base of said frame;

means for positioning said container upon the base of said frame relative to the material compacting means;

a plurality of clamps on the frame sides, each of said clamps comprising a planar member having an inner surface substantially conforming to one side of said container, each of said clamps further being of sufficient rigidity to support one side of said container during compacting;

a plurality of clamp cylinders operated by said pressurized fluid means, each of said clamp cylinders further having a cylinder rod;

means for mounting each of said clamp cylinders to said press frame; and means for pivotally connecting a plurality of said cylinder rods to each of said clamps, allowing said clamps to be pressed against and conform to the sides of said container;

whereby the container is supported during compacting by the material compacting means by a combination of support by the base of said frame, and the inner surfaces of said clamps.

2. The invention of claim 1 wherein one side of the container is further supported by a door, said door having means for fastening to the frame of said press.

3. The invention of claim 1 or 2, in combination with a substantially box shaped container.

* * * * *